United States Patent [19]

Patzer, II et al.

[11] Patent Number: 4,687,569

[45] Date of Patent: Aug. 18, 1987

[54] STEAM STRIPPING PROCESS FOR SOLIDS SEPARATION IN OIL SHALE PROCESSING

[75] Inventors: John F. Patzer, II, Pittsburgh, Pa.; William G. Moon, Newton, N.J.

[73] Assignee: Chevron Research Company, San Francisco, Calif.

[21] Appl. No.: 781,154

[22] Filed: Sep. 27, 1985

[51] Int. Cl.[4] ..... C10G 1/00

[52] U.S. Cl. ..... 208/407; 208/391; 208/424; 208/428; 208/433

[58] Field of Search ..... 208/11 LE

[56] References Cited

U.S. PATENT DOCUMENTS

| | | | |
|---|---|---|---|
| 1,497,607 | 6/1924 | Streppel | 208/11 LE |
| 2,601,257 | 6/1952 | Bucham | 208/11 LE |
| 2,772,209 | 11/1956 | Stewart et al. | 208/11 LE |
| 2,847,306 | 8/1958 | Stewart et al. | 208/11 LE |
| 3,159,562 | 12/1964 | Becherd et al. | 208/11 LE |
| 3,874,116 | 4/1975 | White | 423/648 R |
| 3,890,432 | 7/1975 | White | 423/655 |
| 3,909,389 | 9/1975 | Ruckel et al. | 208/6 X |
| 4,139,450 | 2/1979 | Hanson et al. | 208/11 LE |
| 4,167,470 | 9/1979 | Karnofsky | 208/11 LE X |
| 4,189,376 | 2/1980 | Mitchell | 208/11 LE |
| 4,197,183 | 4/1980 | Audeh | 208/11 LE |

FOREIGN PATENT DOCUMENTS

| | | | |
|---|---|---|---|
| 787898 | 6/1968 | Canada | 208/11 LE |
| 1013695 | 7/1977 | Canada | 208/11 LE |

*Primary Examiner*—Andrew H. Metz
*Assistant Examiner*—William G. Wright
*Attorney, Agent, or Firm*—S. R. LaPaglia; T. G. DeJonghe; Q. Todd Dickinson

[57] ABSTRACT

A process for separating solids from hydrocarbons in a slurry of hydrocarbonaceous solids and solvent is disclosed comprising atomizing the slurry, introducing and mixing the atomized slurry and superheated steam in a stripping zone, vaporizing the hydrocarbons, and separately removing the vapors and the solids. The process is particularly useful in an oil shale recovery process.

11 Claims, No Drawings

STEAM STRIPPING PROCESS FOR SOLIDS SEPARATION IN OIL SHALE PROCESSING

BACKGROUND OF THE INVENTION

The present invention relates to a process for conversion and recovery of kerogen, as oil, from hydrocarbon-containing solids such as oil shale, tar sands and the like, which provides for increased yields of oil products over prior art processes. More specifically, it relates to a process means for separating solids from hydrocarbons using a novel steam stripping method.

The potential reserves of hydrocarbon fuels contained in such sources as oil shale, tar sands, and the like, are known to be very substantial and form a large portion of the known energy reserves of the United States. The estimated reserves contained in the oil shale deposit known as the Green River Formation alone exceed the reserves of liquid hydrocarbons which can be derived from petroleum. As a result of increasing demand for utilization of domestic reserves in meeting liquid fuel requirements, there has been an increased interest in economically recovering liquid hydrocarbons from oil shale, tar sands and the like, on a commercial scale. Various methods of recovery of liquid hydrocarbons from these deposits have been proposed. However, a principal problem with these methods is their high cost, coupled with low recovery of liquid hydrocarbons, which renders the recovered hydrocarbons too expensive to compete with petroleum crudes recovered by more conventional methods.

Kerogen is a solid organic, primarily hydrocarbon, material having a high molecular weight, i.e. greater than about 3,000 grams per mol, which comprises about 10 to about 30 percent by weight of oil shale. The percentage recovery, as oil, of the kerogen originally present in oil shale is low by most methods known in the art. Even the best methods result in relatively high conversion of kerogen to carbonaceous residue and permanent gases, which are of low economic value in comparison with liquid fuels. Accordingly, the present invention provides a method for increasing the yield of liquid product from oil shale.

Many prior art processes rely on retorting of the hydrocarbon-containing solids to effect conversion and recovery of the kerogen as oil. In principle, the retorting of shale and other similar hydrocarbon-containing solids simply comprises heating of said solids to an elevated temperature and recovery of the vapors which are then evolved. However, net yields of kerogen as oil from such processes are typically much lower than the amount of kerogen initially present, due to the destructive distillation retorting process which causes overcracking of kerogen to permanent gases and carbonaceous residue.

Many other prior art processes seek to increase the conversion and recovery of kerogen, as oil, by thermal solution techniques wherein the hydrocarbon-containing solid is slurried with a solvent and then brought to a temperature, generally below that of retorting, where the kerogen is converted to a soluble material and is extracted. Such processes typically advocate the use of a specified solvent, usually a pure chemical or a mixture of hydrocarbons of specified composition, which is alien to the nature of the kerogen conversion products obtained from the hydrocarbon-containing solids. Solvent recovery and product oil separation is then accomplished by fractionation. Little is specified as to the manner of separation of the spent solids from the solvent/product oil stream. A key factor in such processes, wherein large amounts of solvent are required to extract relatively small amounts of product oil from solids, is the economical recovery of solvent from the residual solids.

The recovery of kerogen as oil by thermal solution techniques wherein the hydrocarbon-containing solid is slurried with a process-derived recycle oil is described most fully in the U.S. Bureau of Mines Bulletin No. 533, entitled "Thermal Solution and Hydrogenation of Green River Oil Shale," by H. B. Jensen et al. (1953) and incorporated herein by reference. The Bureau of Mines process initially slurries an oil shale with a retort-derived recycle oil which had a boiling range between 229° and 341° C. (445° and 645° F.) at 2 mmHg. However, it was found that more of the retort-derived recycle oil cracked to lighter components or was condensed to heavier components than was produced by conversion of the kerogen contained within the shale. In an attempt to rectify this loss of recycle oil, shale-derived recycle oil was passed through a reactor several times in order to produce a "thermally stable" recycle oil. When the "thermally stable" recycle oil was used in the thermal solution process, it was again found that more of the recycle oil was cracked to lighter components or condensed to heavier components than was produced by conversion of the kerogen contained in the oil shale. The process as thus described was abandoned because it could not sustain recycle oil balance, that is, more recycle oil was cracked to lighter range material or was condensed to heavier range material than was produced from the conversion of kerogen to oil products. The process, thus, could not recover sufficient recycle oil to slurry with the hydrocarbon-containing solids to sustain a continuous process. Addition of hydrogen gas to the slurry under thermal solution conditions did not alleviate the problem of recycle oil loss. Other prior art along similar lines also fails to address the problem of achieving sustained recycle oil balance.

Moreover, the prior art processes do not teach an effective means for separating the spent shale solids from the desirable hydrocarbons with which they are slurried. The present invention comprises a novel use of steam stripping to effect this separation.

Prior art steam stripping processes would not be effectively adaptable to an oil shale separation such as that required herein. In ordinary steam strippers, for example, steam distillation columns, the material to be stripped is passed countercurrent to the steam in a reaction vessel, which is sometimes baffled. The steam strips off the stripped material overhead and the residue remains behind, on the baffles if used, to be removed. Such a countercurrent stripper could not be operated effectively in the current process since the solid residue would eventually lose enough slurrying liquid that it would cease to flow giving rise to difficult removal problems, and at the elevated operating temperatures of the process disclosed herein, the hydrocarbons sought to be recovered would coke up, seriously reducing yield and recycle and also hindering physical operation.

SUMMARY OF THE INVENTION

In the process of the present invention, a solids-concentrated slurry containing hydrocarbonaceous material boiling at greater than 650° F. and fine mineral solids are atomized and the atomized slurry is introduced into a stripping zone cocurrently with superheated steam in such a manner as to intimately admix the slurry and steam. The steam causes the hydrocarbonaceous material to vaporize, generally in an amount greater than 90% by weight. The vaporized hydrocarbons are removed with the steam and the remaining mineral fines are removed by gravity from the stripping zone and disposed of or combusted to recover residual energy. The hydrocarbons may be processed in any conventional manner, preferably by fractionating and recycling a portion of the higher boiling fractions as the slurry solvent.

DETAILED DESCRIPTION OF THE INVENTION

The shales finding particular use in the invention are those coming from shale deposits in the western states of the United States, especially from the area known as the Piceance Creek Basin. Such shales are often referred to as Green River oil shales. Typical descriptions of composition and properties can be found in Bureau of Mines Report of Investigations numbers 4825, entitled "Properties of Colorado Oil Shales," and 5725, entitled "Ultimate Composition of Organic Material in Green River Oil Shale". However, the process of this invention is also applicable to other hydrocarbon-containing materials, such as tar sands, and to shales from other areas.

Prior to being slurried with the recycle oil, the shale is crushed so that the entire material is finer than 6.35 mm ($\frac{1}{4}$ inch) in diameter. More preferably, the top size of the crushed shale material should be no more than 3.36 mm (0.132 inch) in diameter, or at least −20 mesh U.S. Standard sieve size and preferably greater than 100 mesh, U.S. Standard sieve. Size reduction of the shale particles to top size finer than 0.074 mm (0.0029 inch) is energy wasteful and will also result in highly viscous slurries when the shale particles are slurried with the recycle oil.

In order to reduce the handling of great volumes of extraneous mineral matter and to increase the grade of some naturally-occurring shales, the shale can be beneficiated prior to processing. How the beneficiation is accomplished is dependent on the nature of the oil shale and its source, but preferred methods include: separation using heavy media cyclones (the so-called "sink-float" method) and fine grinding followed by either froth flotation, selective flocculation, or a combination thereof. The beneficiated product should be agglomerated to a size of at least 100 mesh U.S. Standard sieve. In both the natural and beneficiated states, however, the size of the particles should be as coarse as possible while maintaining it at the grade desired.

For run-of-the-mine shale, the grade should be between about 30 to 40 gallons per ton (GPT) and for beneficiated shale, greater than 30 GPT, and preferably between about 40 and 80 GPT.

While the steam stripping process of this invention may be adapted for use in any kerogen-containing solids separation process, for the purposes of illustration the following describes a preferred embodiment of an appropriate process:

The appropriately graded and sized shale particles are slurried in a mixing zone with recycle oil which has been recovered from the products of the process. To start-up the process residuum oil, preferably a heavy gas oil fraction, may be used, although it is intended that uniqueness of the invention resides in achieving appropriate sustained recycle oil balance which would make further make-up unnecessary. The recycle oil is obtained from those fractions of the conversion reaction products which have a true boiling point in excess of 260° C. (500° F.). More preferably, the recycle oil should be obtained from these fractions of the reaction products which have a true boiling point in excess of 300° C. (575° F.). The slurry should be mixed to at least 35 volume percent shale to oil, and preferably 40 volume percent or greater.

The shale/recycle oil slurry is then passed, preferably in an upward, plug-flow manner, through a conversion zone reactor. Kerogen conversion to soluble product oils and mobilization of the soluble oils into the recycle oil takes place within this zone. Although a back-mixed reactor configuration, e.g., a continuous stirred-tank reactor, is possible, the preferred configuration is a tubular plug-flow reactor. To achieve high heat fluxes and low residence times, the tubular plug-flow reactor will likely be contained in a firedfurnace. The recycle oil is also a reactive medium under kerogen conversion conditions. As a result, reaction conditions must be suitable to achieve not only kerogen conversion, but also to maintain recycle oil balance in the system. It is contemplated within the scope of the invention that the slurry may be either preheated to conversion temperature prior to the conversion zone or heated as it passes through the zone. The slurry is heated to between about 750° F. and 950° F., preferably between 850° and 900° F. The residence time of the slurry in the conversion zone is from about 3 to 100 minutes, preferably 4 to 15 minutes, depending upon reactor configuration. The pressure within the conversion zone should be sufficient to maintain any cracked products produced in a liquid phase; that is, from about 200 to 1500 psig and preferably from 400–700 psig. Operation of the conversion reactor outside of the process limitations set forth above results in either net liquid yields for the process which are too low to be of economic interest, i.e. less than 60 weight percent of kerogen, or a process which cannot sustain recycle oil balance.

The phenomena taking place in the conversion zone are complicated. In addition to the kerogen converting to lighter, distillate products, the recycle oil is cracking to lighter molecular weight components, i.e. it is not an inert vehicle in the reactor. One primary key to the process is specification of reaction conditions, e.g. temperature and nominal slurry residence time, which allow positive yields of all oil components exiting the reactor based upon the amount of kerogen entering the reactor. Only when all of the yields, based upon kerogen, are positive, is the process operating in a recycle oil-balanced mode. Liquid yields from the process are in excess of 70 wt. % of the kerogen Specification of the appropriate reactor conditions depends upon the kerogen/recycle oil ratio and upon the distillation range of the recycle oil. A complex interaction between the kinetics of recycle oil cracking and kerogen conversion limits the regions of sustained operability of the process. The size of the shale particles in the slurry has been reduced to finer than 20 microns in size during the conversion step. This size reduction is believed to be the result of the high conversion of kerogen to oils, which effectively removes the "glue" binding the minerals together. It is also desirable for the solids separation step to reagglomerate these particles into a size which can be handled more easily.

From the conversion zone, the slurry is passed to a solids concentration zone. In the solids concentration zone which is ordinarily and preferably a flashing step, hydrocarbon vapors to the light gas oil range, i.e. up to 750° F. components, and steam are flashed off overhead, and the residual solids in the slurry are concentrated to at least 60 percent by weight solids. The solids separation flash zone temperature is from about 800° to 900° F. and preferably around 850° F. The pressure also drops across the solids concentration zone to preferably less than 50 psig down to near atmospheric pressure. Alternatively, the separation may also be accomplished using a vacuum flash, and there may be either a single or a series of flash steps in combination. The light hydrocarbon vapors and steam taken off overhead are taken to a fractionation zone.

Steam Stripping Zone

The solids-concentrated slurry is passed from the solids concentration zone to the steam stripping zone. The steam stripping zone of the present invention is similar to that used in conventional spray drying techniques, except that it operates using a feed and at much higher temperatures and pressures than contemplated in ordinary drying technology. In the preferred stripping method, the slurry is first atomized into a closely controlled droplet size distribution, ordinarily in the range of less than 500 microns average diameter and preferably from 100 to 250 microns.

This atomized slurry is then intimately mixed, preferably in a cocurrent manner, with superheated steam, said steam having a temperature of from about 1000° F. to 1400° F., preferably around 1200° F., and a pressure of from about atmospheric pressure up to 50 psig, preferably close to 50 psig.

One preferred method for both introduction and intimate mixing of the slurry and steam is to use mixing nozzles located internal to the stripping zone wherein the force of the steam exiting the nozzle is sufficient to both atomize and mix with the slurry, which is introduced through the same nozzle. Additional steam, upwards to 90% of the total steam employed, may be introduced through a gas disperser around the spray nozzle. In a more preferred embodiment, the nozzle is a rotary atomizer-type which sprays the atomized slurry/steam mixture radially outward from the nozzle, enhancing vaporization and solids separation. Other atomization methods within the contemplation of the invention include pressure-driven atomizer nozzles, gas/slurry mixing atomizer nozzles, and ultrasonic atomizers.

The intimate mixing of the superheated and pressurized steam with the atomized slurry causes a significant portion, preferably greater than 90%, of the hydrocarbons in the slurry to vaporize. The vaporized hydrocarbons may then be drawn off from the stripping zone by any conventional means such as a pressure gradient, preferably located at a midway point in the zone.

The remaining solid fines, which are now dry and essentially oil-free, i.e. typically containing less than 5 weight percent oil, fall by gravity to the bottom of the reaction vessel and can be removed by ordinary collection means. The fines have also now ordinarily agglomerated to a size typically greater than 50 microns, and upwards to 100 to 500 microns in diameter depending on design conditions, which greatly facilitates separation and removal. They are also typically dry, free-flowing and granular. The fines may be either appropriately disposed of or combusted to recover available surplus energy, which energy may be recycled to the process.

The steam used in the stripping zone may be supplied from any conventional source, including a fixed boiler, a cogeneration process, or it may be process-derived.

Continuing with the preferred process, the hydrocarbon vapors, plus steam, may be passed, as were the light hydrocarbons from the flash, to a fractionation zone. Due to the effectiveness of the steam stripping process, the solids content of the hydrocarbon product is very low, typically less than 0.05 weight percent. The components of the hydrocarbon streams can be fractionated by any conventional means into fractions typically comprising: $C_1$–$C_4$ gases and hydrogen, a naphtha fraction boiling under about 400° F., a mid-distillate fraction boiling in the range 400° to 650° F., a gas oil fraction boiling between 650°–850° F., and heavy oil boiling over 850° F. An FCC-type fractionator is the preferred embodiment. Steam is also separated and condensed, and may be cleaned and recycled to the process.

The recycle oil may be specifically blended from the various fractions, in the mid-distillate to heavy oil range, to maximize yield and, more particularly, to have the ability to achieve sustained recycle oil balance throughout the system. The recycle oil blend most effective for achieving this sustained recycle oil balance is obtained from those fractions having a true boiling point in excess of 500° F. (260° C.), and more preferably having a true boiling point in excess of 650° F. (343° C.). The desired recycle oil may then be recycled to the mixing zone where it is mixed with raw or beneficiated shale to form the feed slurry. The remaining fractionated products are removed for further processing or upgrading as desired.

EXAMPLES

In order to test the effectiveness of the steam stripping method of the present invention, two test slurries were prepared by thermally reacting known oil shale in an FCC-decant oil fraction to thermally dissolve the kerogen contained within the oil shale into the FCC-decant oil fraction, thus producing a finely divided slurry of spent shale solids in an FCC-decant oil-shale oil solvent, in accordance with the teachings of the specification. The test slurries were of the following composition and boiling point distribution:

| Slurry composition | | |
|---|---|---|
| wt. % oil | 49.5 | 52.8 |
| wt. % solids | 50.5 | 47.2 |
| Distillation, wt. % | | |
| ibp–100 C | 0.81 | 0.99 |
| 100–150 C | 0.26 | 0.44 |
| 150–200 C | 1.19 | 1.36 |
| 200–250 C | 4.09 | 4.05 |
| 250–300 C | 7.87 | 7.70 |
| 300–350 C | 11.43 | 11.24 |
| 350–400 C | 12.91 | 12.94 |
| 400–450 C | 10.84 | 11.53 |
| 450–500 C | 6.61 | 7.05 |
| 500–600 C | 10.74 | 11.13 |
| 600–700 C | 6.70 | 6.66 |
| 700–800 C | 5.01 | 4.87 |
| 800–900 C | 3.98 | 3.81 |
| 900+ C | 17.56 | 16.23 |

The spent shale solids contained within each test slurry were mostly finer than 20 microns particle diameter.

The slurry was preheated to 385° C. and introduced into the stripping chamber with steam preheated to approximately 510°–550° C. through a two-fluid nozzle, which was also preheated. The stripping chamber was cylindrical, approximately 30 inches in diameter and four feet in cylindrical height. The top and bottom of the chamber were conical to facilitate introduction and solids removal. While some of the steam was introduced through the nozzle to effect atomization of the slurry, additional steam entered the chamber through a gas disperser situated around the spray nozzle. As it was introduced, the slurry was atomized through the action of the nozzle and the force of the steam. The temperature and atomization action caused the hydrocarbon product to vaporize and it and the steam was drawn off through an exhaust pipe pressure gradient situated in the side of the chamber. The hydrocarbons and steam were passed through a series of condensers, separated, and the product was analyzed.

The residual spent shale solids, comprising mostly silicates and carbonates, fell to the bottom of the chamber. The dry, free-flowing powder, having minor residual oil was recovered, analyzed, and disposed of.

The results of various runs using varying nozzle designs and other process parameters is shown in Table I, below. Additionally in order to compare the actual recovery with a theoretical yield, theoretical thermodynamic calculations using the boiling point distributions, above, and the steam temperatures and flowrates of Table I, were made in accordance with the analyses in FIG. 1. The results of the theoretical calculation for the individual runs are also shown in Table I. This comparison demonstrates the unexpectedly superior results of the present process over even calculated yields.

TABLE I

| | Run | | | | | |
|---|---|---|---|---|---|---|
| | 1 | 2 | 3 | 4 | 5 | |
| Run time, min | 22 | 47 | 67 | 15 | 10 | 152 |
| Flow Rates, kg/h | | | | | | |
| Slurry | (11.1) | 12.0 | 11.1 | 11.5 | 11.5 | 12.0 |
| Steam | 8.4 | 12.0 | 11.5 | 11.5 | 11.5 | 12.0 |
| Temperatures, ° C. | | | | | | |
| Slurry | 385. | 390. | 386. | 388. | 386. | 384. |
| Nozzle Steam | 585. | 548. | 530. | 511. | 512. | 520. |
| Plenum Steam | . | 548. | 560. | 550. | 475. | 505. |
| Feed Slurry | | | | | | |
| Solids, wt. % | 50.5 | 47.2 | 47.2 | 47.2 | 47.2 | 47.2 |
| Solids carbon, wt. % | 5.4 | 10.75 | 10.75 | 10.75 | 10.75 | 10.75 |
| Products | | | | | | |
| Wt. % solids in oil | . | 0.04 | 0.03 | . | 0.29 | 0.04 |
| Stripped solids | | | | | | |
| wt. % oil | 3.63 | 6.45 | 3.30 | 0.10 | 4.03 | 0.80 |
| wt. % carbon | 10.6 | 17.57 | 18.45 | 19.38 | 20.52 | 16.85 |
| Oil Recovery, wt. % | | | | | | |
| Calculated experimental | 89.3 | 85.5 | 87.6 | 89.8 | 84.4 | 92.3 |
| Expected (thermodynamic) | 75.0 | 77.0 | 77.4 | 76.8 | 73.6 | 74.9 |

FIGURE I

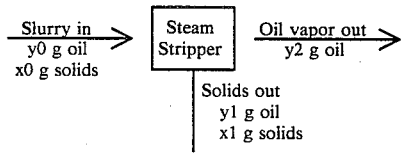

Notation:

w1 wt.fr. solubles on spent solids (measured)

z0 wt.fr. carbon on solids fed to stripper (measured)

z1 wt.fr. carbon on solids removed from stripper after insolubles test (measured)

Assumption: all solids removed in solids stream $\rightarrow x1 = x0$

Assumption: oils with solids comprised of soluble oils and residue oil, i.e., $$y1 = y1s + y1r$$

Assumption: solids removed from stripper are comprised of original solids, x0, plus unstripped soluble oil, y1s, plus residue oil, y1r.

From insolubles test, soluble oils are given by $$y1s/(y1s + y1r + x0) = w1,$$

Assumption: All oils contain 85 wt. % carbon

From spent shale carbon test, residue oil is given by $$y1r/(y1r + x0) = (z1 - z0)/0.85$$

Combining all the above, $$y1r = x0(z1 - z0)/(0.85 - z1 + z0)$$

$$y1s = w1\ (y1r + x0)/(1.0 - w1)$$

and, oil stripped from the solids, $$y2 = y0 - y1r - y1s$$

to give the fraction stripped from the solids as $$f = y2\ /y0$$

What is claimed is:

1. In a process for recovering oil from a kerogen containing slurry comprising oils with a boiling point greater than 650° F. and fine solids, the separation method comprising:

(a) atomizing said kerogen containing slurry;

(b) introducing said atomized slurry into a stripping zone;

(c) introducing superheated steam cocurrently with said atomized slurry in such a manner as to intimately mix said steam and said atomized slurry, said steam being introduced at a temperature of above about 1,000° F.

(d) causing a significant portion of the hydrocarbons in said slurry to vaporize;

(e) removing said vaporized hydrocarbons and steam from said stripping zone;

(f) removing said now-separated fine solids separately from said stripping zone.

2. The process as claimed in claim 1 wherein said fine solids are spent oil shale solids and said oil is the product of a kerogen conversion process.

3. The process as claimed in claim 2 wherein the solids are of an average diameter of less than 20 microns.

4. The process as claimed in claim 1 wherein the atomized slurry is atomized to droplets of less than 500 microns average diameter.

5. The process as claimed in claim 4 wherein the average droplet size is from about 100 to 250 microns average diameter.

6. The process as claimed in claim 1 wherein the significant portion of hydrocarbon vaporized in step (d) is greater than 90%.

7. The process as claimed in claim 1 wherein said hydrocarbon vapors are removed from said stripping zone using a pressure gradient.

8. The process as claimed in claim 1 wherein the fine solids of step (f) fall by gravity to the bottom of said reaction zone and are removed.

9. The process as claimed in claim 1 wherein the fine solids of step (f) contain less than 5 percent residual hydrocarbon.

10. The process as claimed in claim 8 wherein the fine solids agglomerate into essentially dry, free-flowing material greater than about 50 microns in diameter.

11. The process as claimed in claim 10 wherein the agglomerated fines are between about 100 to 500 microns in diameter.

* * * * *